US008646209B2

(12) United States Patent
Hampel et al.

(10) Patent No.: US 8,646,209 B2
(45) Date of Patent: Feb. 11, 2014

(54) DEVICE FOR ADJUSTING AND LOCKING THE POSITION OF A GUIDE RAIL FOR A MOVABLE WINDOWPANE IN A VEHICLE DOOR

(75) Inventors: Klaus Hampel, Coburg (DE); Jürgen Knorr, Weidhausen (DE); Detlev Mathes, Itzgrund (DE); Michael Pangerl, Taufkirchen (DE)

(73) Assignees: Brose Fahrzeugteile GmbH & Co. KG, Coburg (DE); Bayrische Motoren Werke AG, Munich (DE)

( * ) Notice: Subject to any disclaimer, the term of this patent is extended or adjusted under 35 U.S.C. 154(b) by 0 days.

(21) Appl. No.: 13/808,271

(22) PCT Filed: Jun. 28, 2011

(86) PCT No.: PCT/EP2011/060778

§ 371 (c)(1),
(2), (4) Date: Jan. 23, 2013

(87) PCT Pub. No.: WO2012/004151

PCT Pub. Date: Jan. 12, 2012

(65) Prior Publication Data

US 2013/0111820 A1 May 9, 2013

(30) Foreign Application Priority Data

Jul. 5, 2010 (DE) ..... 20 2010 009 865 U

(51) Int. Cl.
*E05D 15/10* (2006.01)

(52) U.S. Cl.
USPC ..... 49/212

(58) Field of Classification Search
USPC ..... 49/212, 348, 349, 352
See application file for complete search history.

(56) References Cited

U.S. PATENT DOCUMENTS

| | | | | |
|---|---|---|---|---|
| 4,956,942 | A * | 9/1990 | Lisak et al. | 49/502 |
| 5,430,976 | A * | 7/1995 | Wirsing | 49/452 |
| 5,622,005 | A * | 4/1997 | Ochenski et al. | 49/375 |
| 5,855,095 | A * | 1/1999 | Dedrich et al. | 49/502 |

(Continued)

FOREIGN PATENT DOCUMENTS

| | | |
|---|---|---|
| DE | 20116811 | 2/2002 |
| DE | 102006025511 | 11/2007 |
| EP | 1327544 | 7/2003 |
| EP | 2093085 | 8/2009 |

OTHER PUBLICATIONS nternational Search Report for International Application No. PCT/EP2011/060778 dated Sep. 20, 2011.

*Primary Examiner* — Jerry Redman
(74) *Attorney, Agent, or Firm* — Renner, Otto, Boisselle & Sklar, LLP

(57) ABSTRACT

The invention relates to the adjusting and locking of the position of a guide rail for a movable window pane in a vehicle door. A device, a vehicle door equipped therewith and a tool provided for the adjusting and locking are disclosed. In the vehicle door, a first mounting plate mounted on the rail side and a second mounting plate mounted on the door side are provided, which are connected to one another by screw-fastenable mounting means. One of the mounting plates comprises an engaging element for an eccentric lever, which on rotation brings about a mutual translational displacement of the mounting plates in an adjusting (Y) direction.

20 Claims, 5 Drawing Sheets

(56) References Cited

U.S. PATENT DOCUMENTS

| | | | | |
|---|---|---|---|---|
| 5,927,021 | A * | 7/1999 | Kowalski et al. | 49/502 |
| 6,807,773 | B2 * | 10/2004 | Cardine et al. | 49/212 |
| 7,043,878 | B2 * | 5/2006 | Cardine et al. | 49/212 |
| 7,246,464 | B2 * | 7/2007 | Castellon | 49/212 |
| 7,640,697 | B2 * | 1/2010 | Florentin et al. | 49/348 |
| 8,069,610 | B2 * | 12/2011 | Graf et al. | 49/348 |
| 8,091,284 | B2 * | 1/2012 | Iennarella et al. | 49/348 |
| 8,127,493 | B2 * | 3/2012 | Cappelli et al. | 49/212 |
| 2003/0066243 | A1 * | 4/2003 | Cardine et al. | 49/212 |
| 2003/0131534 | A1 * | 7/2003 | Cardine et al. | 49/212 |
| 2009/0211159 | A1 | 8/2009 | Iennarella et al. | |

* cited by examiner

DEVICE FOR ADJUSTING AND LOCKING THE POSITION OF A GUIDE RAIL FOR A MOVABLE WINDOWPANE IN A VEHICLE DOOR

TECHNICAL FIELD

The present application claims priority under 35 U.S.C. §119 to the following German patent application, the whole content of which is hereby expressly incorporated by reference for disclosure purposes: DE 20 2010 009 865.3, filed 5 Jul. 2010, and claims benefit of International Application PCT/EP2011/060778, filed 28 Jun. 2011.

The invention relates to a device for adjusting and locking the position of a guide rail for a movable window pane in a vehicle door. The invention also relates to a vehicle door equipped with the device and a tool proposed for the adjusting and locking.

BACKGROUND ART

Vehicle doors with movable window panes or adjustable cable-driven window lifters have long been known. In particular, in the case of motor vehicles with frameless movable window panes, it is required for the window panes to be pressed with a pre-definable pressing force against the seal on the bodywork side. Too low a pressing force would lead, at high speeds, to lifting off of the window pane and thus to undesirable wind noise. In order to adjust the pressing force, the position of the guide rails mounted in the motor vehicle door is altered, particularly in the Y-position (tilt) thereof.

DE 10 2004 027 253 A1 discloses a device of this type for adjusting and locking a movable window pane. Each guide rail is provided with a mounting plate mounted on the rail side (section 9 in FIG. 1 therein). This rail-side mounting plate is fastened to a mounting plate (position angle 11) mounted on the door side. A special screw connection which is equipped with an eccentric lever (element 2 in FIG. 4) is proposed as the mounting means. The eccentric lever is in engagement with an engaging element which is configured as a slot (reference sign 5 in FIGS. 2 and 3), so that given a rotary movement of the eccentric lever, the rail-side mounting plate is moved translationally and is displaced relative to the mounting plate mounted on the door side. For this purpose, the slot serving as an engaging element (reference sign 5 in FIG. 3) must extend vertically (Z-direction), i.e. perpendicularly to the adjusting direction (Y-direction). The adjustment is undertaken with the screw connection slightly loosened, so that the Y position of the mounting plate (section 9 in FIG. 3) on the rail side is adjusted by rotating the eccentric lever. In order to rotate the eccentric lever, said lever has a tool connection (internal Torx profile 15 in FIG. 4) for a socket spanner or the like. If, by rotating the eccentric lever, the desired Y-position of the guide rail has been adjusted, said position can be locked or fixed by means of a further socket spanner which engages with a fastening nut. This known solution has the disadvantage that following setting or adjustment of the Y-position of the guide rail, the eccentric lever must remain at the deployment site thereof because said eccentric lever is an integral component of the screw connection there. A solution wherein the weight or the material of the eccentric lever and the space required could be significantly reduced or even saved altogether would be desirable.

Thus a device for adjusting and locking the position of the guide rail is known which has a first mounting plate mounted on the rail side and a second mounting plate mounted on the door side which are connected to one another by means of screw-fastenable mounting means, wherein one of the mounting plates comprises an engaging element which comprises, for example, a vertical slot for an eccentric lever.

SUMMARY

It is an object of the present invention to improve a device of the aforementioned type for adjusting and locking such that a solution is proposed which saves space and material to the greatest possible extent.

This aim is achieved with a device having the features described in the following disclosure.

Furthermore, in the alternative independent claims, a vehicle door equipped with such a device and a tool for use with such a device are proposed.

It is therefore proposed that the mounting plate comprising the engaging element has a slot extending in the adjusting direction, in which one of the screw-fastenable mounting means is displaceably received, and that at least one of the mounting means is configured as a pivot point for the eccentric lever, so that the eccentric lever can be configured as part of a separate or external tool. It is therefore made possible through the design proposed here to carry out the position adjustment and the locking of the guide rail by means of a separate tool. This is essentially achieved in that at least one of the mounting means is configured as a rotary bearing or pivot point for the eccentric lever and that the mounting plate which comprises the engaging element for the eccentric lever itself has a slot which extends in the adjusting direction (preferably the Y-direction or transverse direction) and serves as a guide for the mutual displacement of the mounting plates. The adjusting and locking device is configured by means of said features such that the eccentric lever does not have to be an integral component, but can be part of a separate or external tool. In this way, weight, material and space are all saved. In addition, for locking, simple economical mounting means in the form of screws and nuts can be used. The invention is particularly suitable for adjusting the Y-position of guide rails for frameless window panes.

In a preferred embodiment, the slot (guide in the Y-direction) and the engaging element for the eccentric lever are provided at the mounting plate on the door side. The engaging element is preferably also configured as a slot, which then extends in a direction essentially perpendicularly to the adjusting direction (vertically oriented slot). As the engaging element, for example, a spigot or the like which engages in a fork which is part of the eccentric lever can be provided.

As mounting means, screws and nuts are preferably used, wherein at least one of said fastening means is configured as a pivot point or a rotary bearing for the eccentric lever in that said fastening means is configured as a round screw or a round nut or the like.

The tool according to the invention is distinguished in being configured tubular and in having a tubular shaft at one end of which an eccentric lever which engages in the engaging element of one mounting plate is arranged, and that one end of the tubular shaft is configured to grasp a screw-fastenable fastening element (preferably a screw or a nut) mounted in the device in form-fitting manner and to use said mounting means as a rotary bearing for the eccentric lever. In particular, the tool is configured such that the interior diameter of the tubular shaft at least corresponds to the exterior diameter of a screw head or a nut. Thus any desired screw head or any desired nut can be used as a rotary bearing or pivot point. Preferably, provided at the other end of the tubular shaft is an adjusting handle, through actuation of which, rotation of the eccentric lever and thus adjustment of the Y-position of the guide rail is carried out.

The tool is also preferably configured such that a rod is rotatably arranged in the tubular shaft, at the free end of which locking means, in particular a spanner element is arranged and, at the other end thereof, a locking handle is arranged. The tool therefore fulfils two functions, specifically an adjusting function by actuating the adjusting handle attached to the tubular shaft and a locking function by actuating the locking handle and the rod connected thereto and arranged in the interior of the shaft.

BRIEF DESCRIPTION OF THE DRAWINGS

These and other advantages are disclosed in the subclaims. The invention will now be described by reference to exemplary embodiments and with the aid of the accompanying schematic drawings, in which:

DETAILED DESCRIPTION

Figure 1A:
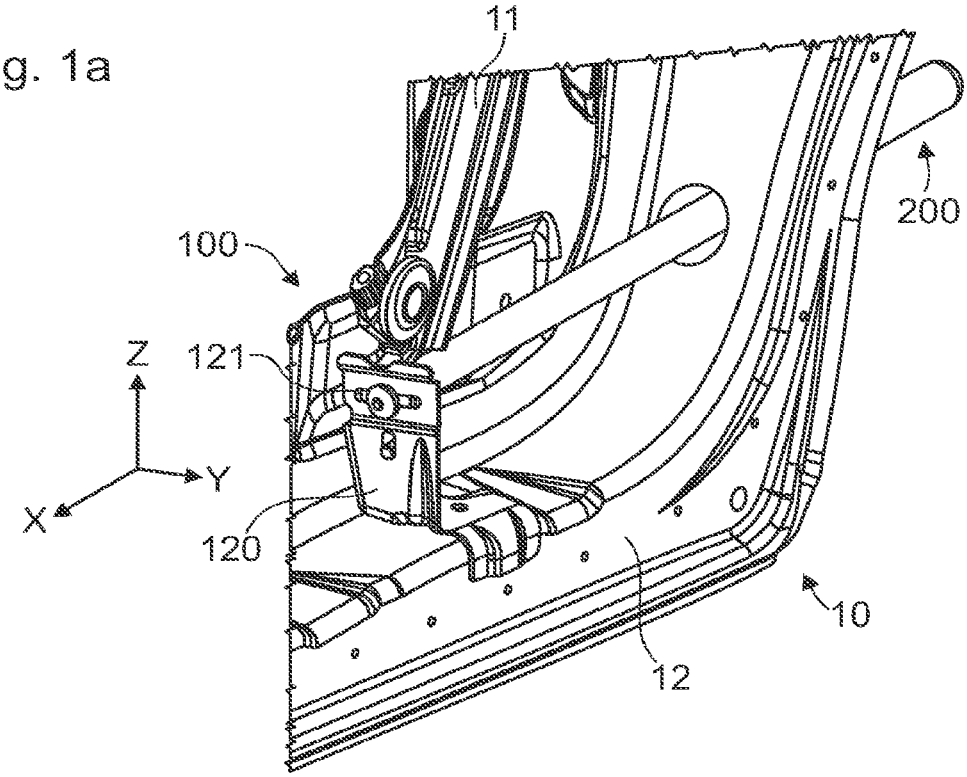
FIGS. 1*a* to *f* relate to a first exemplary embodiment and show, in different schematic representations or views, the design of the device according to the invention; they also illustrate the chronological progress of the adjusting and locking procedure.
Figure 1B:
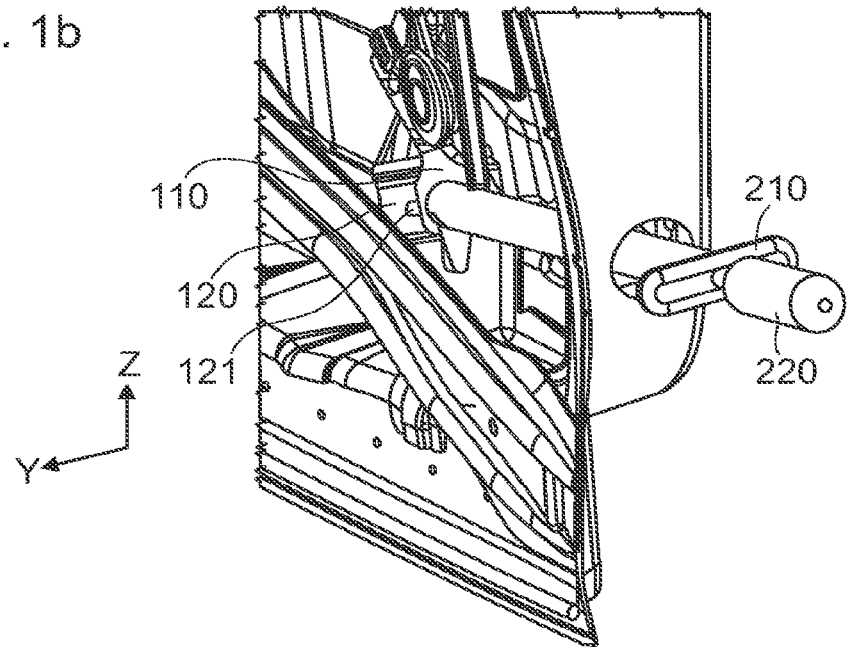

FIGS. 1*a* and *b* show, in two views, the principle construction of a device 100 for adjusting and locking a guide rail 11 in a vehicle door 10. The device 100 comprises, in particular, a first mounting plate 110 which is provided, for example, configured integrated, at the guide rail 11, and is referred to in the following as the rail-side mounting plate. The device 100 also comprises a second mounting plate 120, which is connected to the door interior panel 12 of the vehicle door 10 and is therefore also referred to below as the door-side mounting plate. Using this device, the position of the guide rail 11 can be adjusted and locked in the adjusting direction, that is, here in the Y-direction.

Figure 1C:
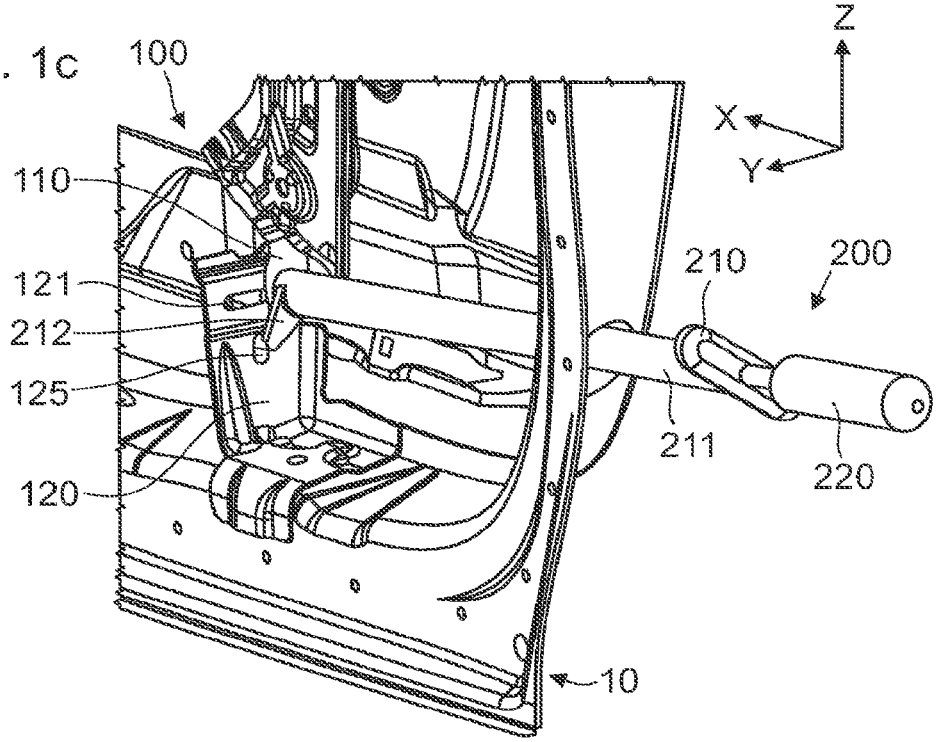
Figure 1D:
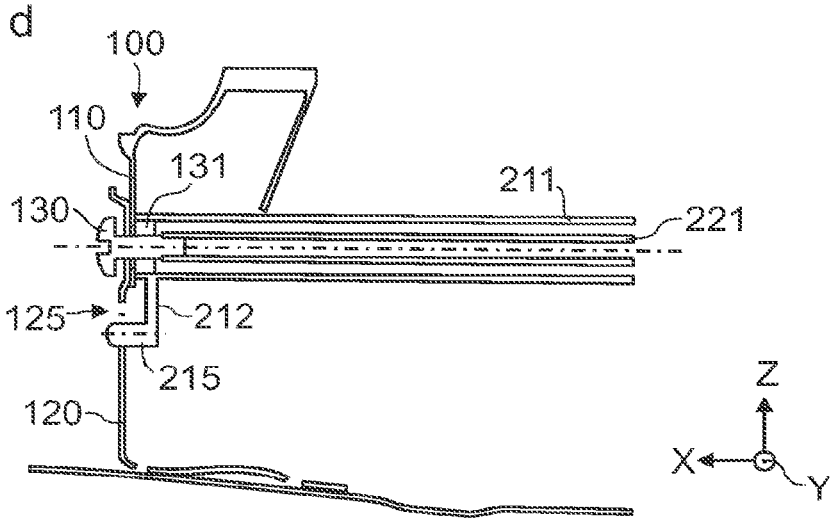
Figure 1E:
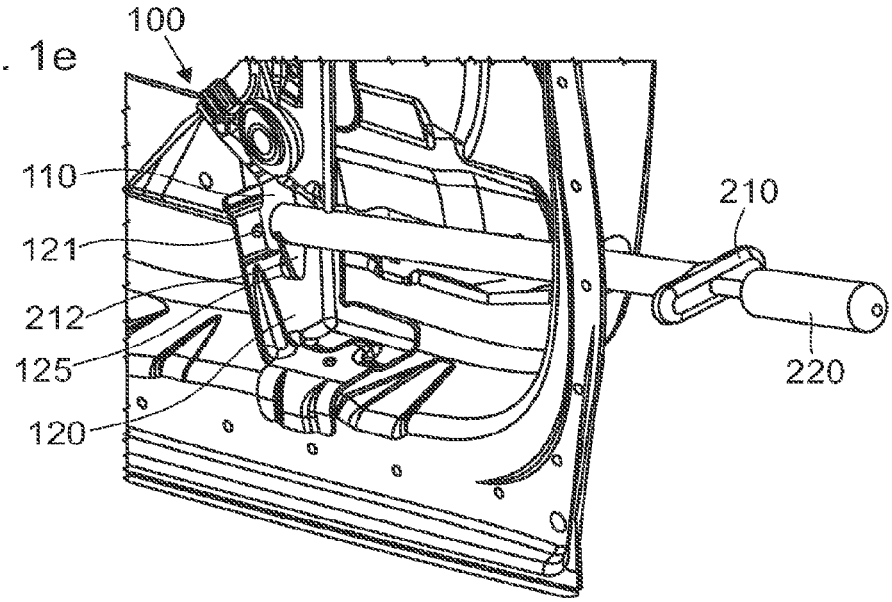
Figure 1F:
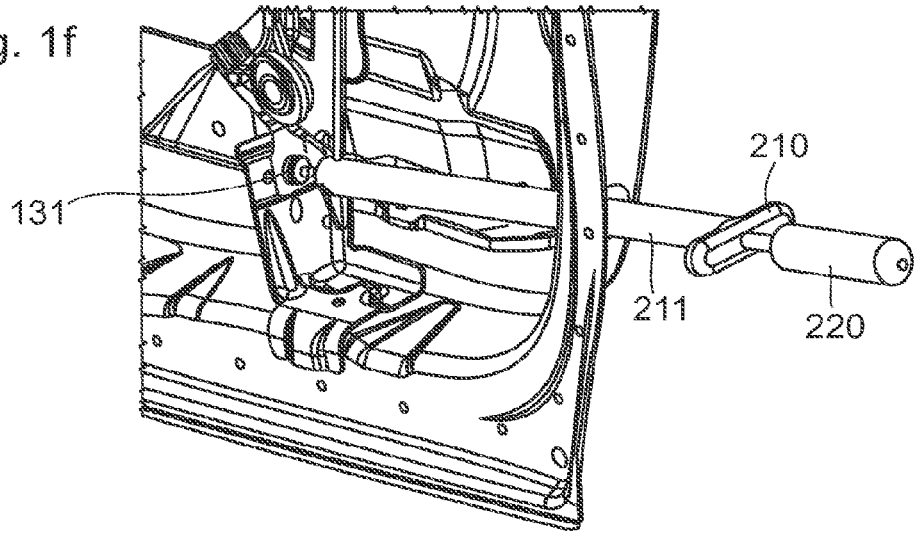

As shown, in particular, by the cross-sectional view of FIG. 1*d*, the two mounting plates 110 and 120 overlap and are fastened to one another by means of a screw fastening, specifically by a screw 130 and a nut 131. Firstly, the screw connection is loosened for the purpose of adjusting the Y-position or tilt of the guide rail 11 (see FIG. 1*a*), so that the mounting plate 110 can be displaced relative to the other mounting plate 120. The screw shaft 130 is guided in the horizontal slot 121 which is provided at the second mounting plate 120. The eccentric lever 212 of the tool 200 has a spigot 215 which engages in a further slot 125, which is also provided at the second mounting plate 120. This second slot 125 provides an engaging element for the eccentric lever 225 and extends essentially in the vertical direction, whereas the other slot 121 extends in the horizontal or Y-direction. The pivot point (rotary bearing) of the eccentric lever 212 mounted on the exterior tube 211 is provided at one of the mounting means, here for example, at the nut 131. This can be achieved, for example, in that the interior diameter of the tube 211 is selected large enough to encompass the exterior diameter of the nut 131. If now, by actuating the adjusting handle 210, the exterior tube 211 is rotated, the eccentric lever 212 also undergoes a rotation and, due to the restricted guidance thereof in the slot 125, also a translational movement of the screw 130 and of the mounting plate 110.

The sequence of the adjustment and locking is illustrated in greater detail by FIGS. 1*c-f*. Both the adjustment and the locking are carried out by means of the tool 200 which is described in greater detail below and is configured essentially tubular and comprises an exterior tube or a tubular shaft 211 and a rod 221 arranged rotationally therein. Arranged at the free end of the exterior tube 211 is the eccentric lever 212, the spigot or peg 215 of which is brought directly into engagement with the vertical slot 125 of the door-side mounting plate 120 (see FIG. 1*d*). The free end of the tubular shaft 211 also encompasses the nut 131, which serves here as a rotary bearing or pivot point for the eccentric lever 212. The adjusting handle 210 is provided at the other end of the tubular shaft 211 in order to be able to rotate the eccentric lever 212.

As illustrated in FIG. 1*c*, the guide rail and the mounting plate 110 mounted thereon are initially situated in a starting position, here, for example, at the right-hand stop of the slot 121 which serves as a guide. Firstly, the free end of the tool 200 which comprises the eccentric lever 212 is introduced through an assembly aperture provided in the vehicle door. The end of the tubular shaft 211 is then fitted over the nut 131 of the screw connection in order to provide a pivot point for the eccentric lever 212. The screw connection has initially not yet been tightened, so that in a first step, by rotating the adjusting handle 210 or the eccentric lever 212, a linear displacement of the screw 130 guided in the slot is brought about, so that the mounting plate 110 is moved and an adjustment of the Y-position of the guide rail is brought about (see FIGS. 1*c* and 1*d*).

Once the desired position has been found, (see FIG. 1*e*), in a further step, the screw connection is tightened, so that locking of the guide rail in the desired Y-position is achieved. For locking, a locking handle 220 which has a through connection to the screw connection via a rod 221 arranged in the rod 211 is provided at the tool 200. In the example shown here (see FIG. 1*d*), the rod 211 is configured tubular and has, at the free end thereof, a coupling element for form-fitting connection to the end of the screw shaft, which is configured hexagonal. Therefore, the free end of the rod 211 has a spanner function which creates a form-fit with the screw 130 and thus enables tightening of the screw 130 by rotating the locking handle 220. Once the screw connection has been tightened and thereby the locking of the guide rail brought about, the tool 200 can be removed again. Only the absolutely necessary design elements remain in the vehicle door, in particular the elements of the screw connection, which may be typical screws and nuts. No assembly of eccentric elements is required.

Figure 2A:
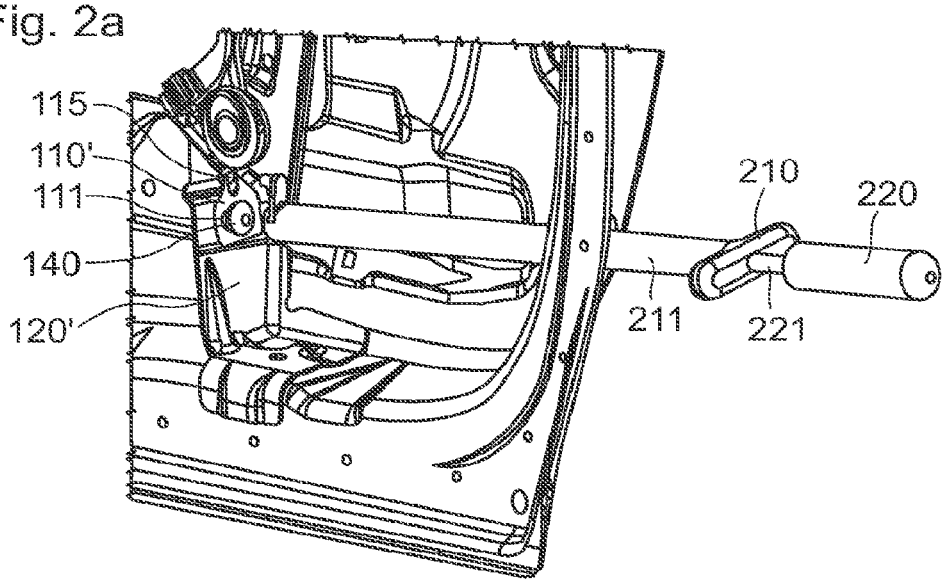
FIGS. 2*a* to *c* relate to a second exemplary embodiment and show different schematic representations and views thereof.
Figure 2B:
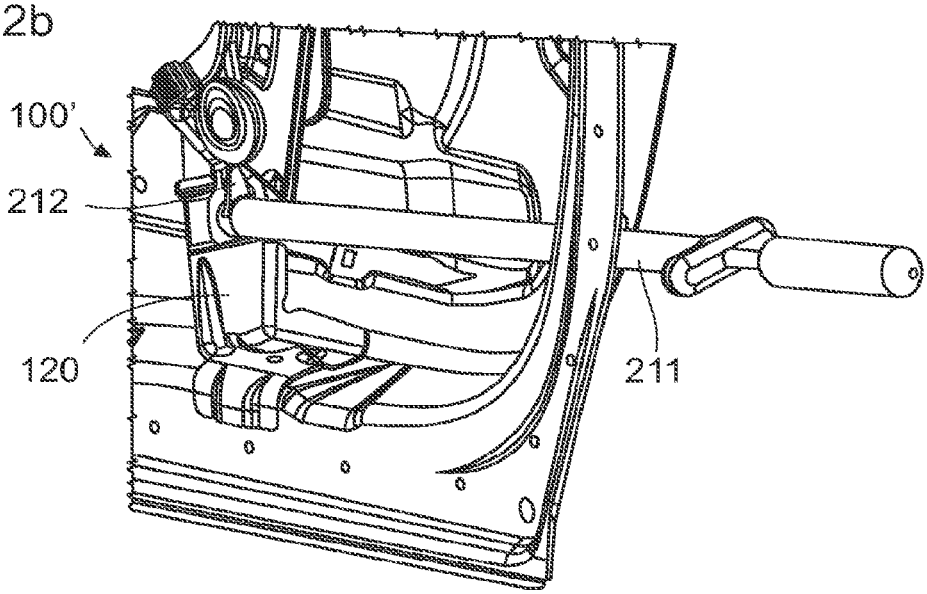
Figure 2C:
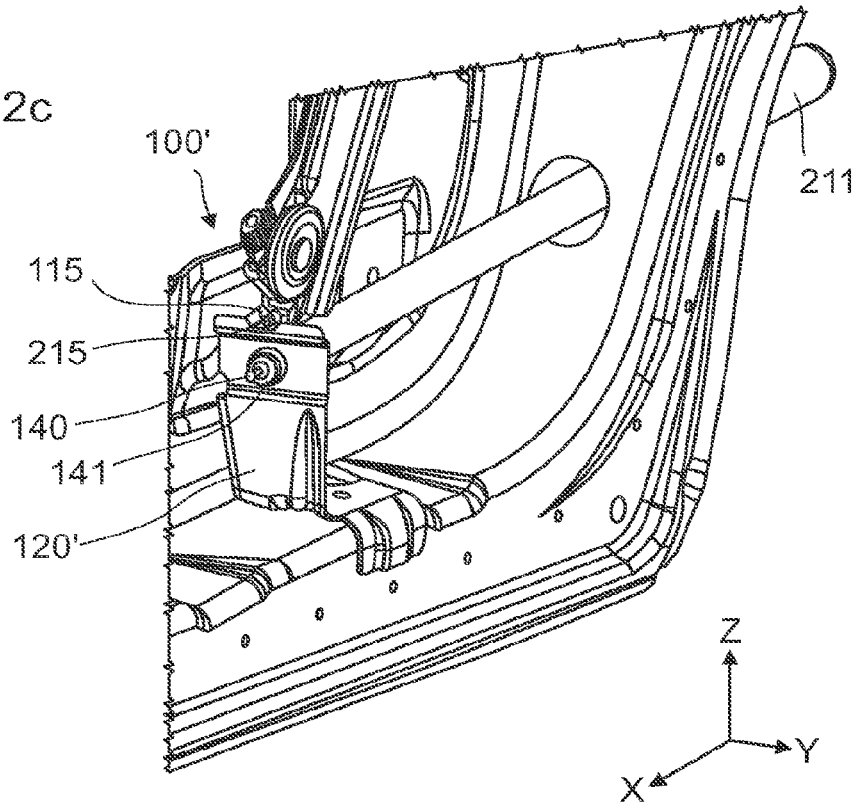

Another embodiment of the invention will now be described making reference to FIGS. 2*a* to *c*. Here, the horizontal slot 111 (guidance in the Y-direction) is not arranged in the door-side mounting plate, but in the rail-side mounting plate 110'. The screw 140 is guided in this slot 111 when the Y-position is adjusted. The vertical slot 115 configured as the engaging means for the eccentric lever 212 is also provided at the rail-side mounting plate 110'. The door-side mounting plate 120', however, has no slot, but rather has a circular hole with a nut 141 and therefore represents the fixed point for the screw connection.

In order to adjust and lock the guide rail, firstly, with the screw connection loosened, the tool 200 is introduced so that the eccentric lever 212 is effectively hooked into the vertical slot 115 (engaging element). The tube 211 of the tool encompasses, with the free end thereof, the fastening screw 140, so that the eccentric lever can be rotated about said pivot point or said rotary bearing. Through the rotation of the eccentric lever 212, adjustment of the Y-position of the guide rail is achieved.

Once the desired position has been reached, then by means of the locking handle 220 and the rod 221 connected thereto, tightening of the screw connection can be brought about. For this purpose, the screw 140 is configured, for example, as a hexagonal head cap screw so that said screw can be tightened with a rod, the free end of which is configured as a hexagonal key. Once the locking has been carried out, the tool can be removed again without difficulty.

Many other variants and modifications are conceivable. For example, a spigot or a projecting peg which engages in the counter-part of a corresponding eccentric lever can be used as the engaging element (see 115 in FIG. 2*a*). The connection between the inner rod (see 221 in FIG. 1*d*) and the screw connection can also be achieved by means of other designs. For example, the inner rod can be configured as a smaller tube and can encompass the shaft of a screw (as shown on FIG. 1*d*) or the inner rod can be made from solid material and can engage in the form of a hexagonal key in a screw head (as shown in FIG. 2*a*).

The invention proposed here not only has the advantage that, following assembly, no excessive quantity of superfluous material or components remain, but that also a tool can be used which is very easy and quick to operate. For the connecting means, screws and nuts can be used which have a common hexagonal form or the like. It is also possible that the outer tube of the tool can encompass and use the nut or the screw head without difficulty. A screw can also be used which provides possibilities for engagement with tools either at the shaft or the head thereof. As illustrated, by way of example, in FIG. 1*d*, the screw 130 can have a slit or a cross-head profile at the head thereof a can have a hexagonal form at the shaft thereof. Tightening is therefore possible from either side.

Apart from the actual device, the tool has also been described here and is distinguished by having essentially a concentric tubular construction of at least two tubes or rods. Said tool can be configured very stable and user-friendly and enables easy access by means of an assembly aperture in the frame of the vehicle door.

A vehicle door has also been described which is equipped with such an adjusting and locking device. Furthermore, the method for adjusting and locking the position of the guide rail has been described. Altogether, with the design according to the invention, a rapid, effective adjusting and locking capability is provided, wherein, following assembly, no superfluous components or parts thereof have to remain in the vehicle door. The proposed design is suitable, in particular, for the use of typical standard-conform screw connections. For this reason also, a very economical realisation of the invention is achievable.

REFERENCE SIGNS

10 Vehicle door
11 Guide rail for adjustable (frameless) window pane
12 Door interior panel
100 Device for adjusting and locking the Y-position of the guide rail
110 First (rail-side) mounting plate
120 Second (door-side) mounting plate
121 First (horizontal) slot as guide for the Y-adjustment
125 Engaging element for the eccentric lever, configured here as a vertical slot
200 Tool for adjusting and locking
210 Adjusting handle
211 Tubular shaft
212 Eccentric lever
215 Spigot for engaging in the vertical slot 125
220 Locking handle
221 Rod arranged rotatably in shaft
130 Screw (first screw-fastenable mounting means)
131 Nut (second screw-fastenable mounting means)
100' Device in alternative configuration, comprising:
110' Rail-side mounting plate, with:
  111 Horizontal slot (adjusting guide)
  115 Engaging element (vertical slot) for eccentric lever
120' Door-side mounting plate
140 Screw (first screw-fastenable mounting means)
141 Nut (second screw-fastenable mounting means)

The invention claimed is:

1. Device for adjusting and locking the mounting position of a guide rail for an adjustable window pane in a vehicle door, which has a first mounting plate connected to the guide rail and a second mounting plate connected to the vehicle door, which are connected to one another by means of screw-fastenable mounting means, wherein one of the mounting plates comprises an engaging element for an eccentric lever, which on rotation brings about a mutual translational displacement of the mounting plates in an adjusting (Y) direction, wherein one of the mounting plates which comprises the engaging element has a first slot extending in the adjusting (Y) direction, in which one of the screw-fastenable mounting means is displaceably received, at least one of the mounting means is configured as a rotary bearing for the eccentric lever, and the eccentric lever is configured as part of a separate tool and wherein the tool is configured tubular and comprises a tubular shaft, at the free end of which an eccentric lever is arranged which engages in an engaging element, which has a mounting plate arranged in the device, and wherein the free end of the tubular shaft is configured to grasp in form-fitting manner a screw-fastenable mounting means provided in the device and to use said mounting means as a rotary bearing for the eccentric lever.

2. Device according to claim 1, wherein the second mounting plate comprises the engaging element for the eccentric lever.

3. Device according to claim 2, wherein the engaging element is configured as a second slot in the first mounting plat or the second mounting plate, wherein the slot extends in a direction (Z) which is oriented essentially perpendicular to the adjusting direction (Y).

4. Device according to claim 1, wherein the engaging element is configured as a second slot in the first mounting plate or the second mounting plate, wherein the slot extends in a direction (Z) which is oriented essentially perpendicular to the adjusting direction (Y).

5. Device according to claim 1, wherein the screw-fastenable mounting means comprise at least one screw and one nut, wherein at least one of the mounting means is configured as a rotary bearing for the eccentric lever.

6. Device according to claim 1, wherein the eccentric lever is arranged as part of the tool at an end of a tubular shaft, the inner diameter of which corresponds at least to the outer diameter of the screw head or of the nut.

7. Device according to claim 1, wherein the tool has a tubular shaft, at an end of which the eccentric lever is arranged and at another end of which an adjusting handle is arranged.

8. Device according to claim 1, wherein the tool comprises a tubular shaft and, rotatably arranged therein, a rod at an end of which a coupling element.

9. Tool for use in the device according to claim 1, wherein the screw-fastenable mounting means is a screw head or a nut, wherein the free end of the tubular shaft has an inner diameter which corresponds at least to the exterior outer diameter of the screw head or the nut.

10. Tool according to claim 9, wherein an adjusting handle is arranged at the other end of the tubular shaft.

11. Tool according to claim 9, wherein arranged in the tubular shaft is a rotatably arranged rod, at the free end of which a coupling or locking element is arranged and, at the other end thereof, a locking handle is arranged.

12. Tool according to claim 9, wherein arranged in the tubular shaft is a rotatably arranged rod, at the free end of which a spanner element is arranged and, at the other end thereof, a locking handle is arranged.

13. Tool for use in the device according to claim 1, wherein an adjusting handle is arranged at another end of the tubular shaft.

14. Tool according to claim 13, wherein arranged in the tubular shaft is a rotatably arranged rod, at the free end of which a coupling or locking element is arranged and, at the other end thereof, a locking handle is arranged.

15. Tool according to claim 13, wherein arranged in the tubular shaft is a rotatably arranged rod, at the free end of which a spanner element is arranged and, at the other end thereof, a locking handle is arranged.

16. Tool for use in the device according to claim 1, wherein arranged in the tubular shaft is a rotatably arranged rod, at the free end of which a coupling or locking element is arranged and, at the other end thereof, a locking handle is arranged.

17. Device according to claim 1, wherein the screw-fastenable mounting means comprise at least one screw and one nut, wherein at least one of the mounting means is configured as a round screw or a round nut.

18. Device according to claim 1, wherein the tool comprises a tubular shaft and, rotatably arranged therein, a rod at an end of which a spanner element is arranged and at the other end of which a locking handle is arranged.

19. Tool for use in the device according to claim 1, wherein arranged in the tubular shaft is a rotatably arranged rod, at the free end of which a spanner element is arranged and, at the other end thereof, a locking handle is arranged.

20. Vehicle door comprising a device for adjusting and locking the mounting position of a guide rail for an adjustable window pane in the vehicle door, said device having a first mounting plate connected to the guide rail and a second mounting plate connected to the vehicle door, which are connected to one another by screw-fastenable mounting means, wherein one of the mounting plates comprises an engaging element for an eccentric lever, which on rotation brings about a mutual translational displacement of the mounting plates in an adjusting (Y) direction, wherein one of the mounting plate having the engaging element has a first slot extending in the adjusting direction (Y), in which one of the screw-fastenable mounting means is displaceably received, and wherein at least one of the mounting means is configured as a rotary bearing for the eccentric lever, so that the eccentric lever can be configured as part of a separate too land wherein the tool is configured tubular and comprises a tubular shaft, at the free end of which an eccentric lever is arranged which engages in an engaging element, which has a mounting plate arranged in the device, and wherein the free end of the tubular shaft is configured to grasp in form-fitting manner a screw-fastenable mounting means provided in the device and to use said mounting means as a rotary bearing for the eccentric lever.

* * * * *